United States Patent [19]

Brown

[11] 3,978,550

[45] Sept. 7, 1976

[54] HINGE DISCONNECT MEANS FOR A DOOR

[75] Inventor: William J. Brown, Naperville, Ill.

[73] Assignee: Caterpillar Tractor Co., Peoria, Ill.

[22] Filed: June 9, 1975

[21] Appl. No.: 585,144

[52] U.S. Cl. ..... 16/171; 16/135; 16/166

[51] Int. Cl.[2] ..... E05D 1/06

[58] Field of Search ..... 16/128 R, 171, 172, 16/148, 191, 85, 82, 135, 166

[56] References Cited

UNITED STATES PATENTS

| | | | |
|---|---|---|---|
| 488,509 | 12/1892 | Sweeney | 16/171 X |
| 2,102,291 | 12/1937 | Soss | 16/148 |
| 3,124,830 | 3/1964 | Gionet | 16/135 X |
| 3,171,156 | 3/1965 | Peras | 16/135 |

*Primary Examiner*—G. V. Larkin
*Attorney, Agent, or Firm*—Phillips, Moore, Weissenberger, Lempio & Strabala

[57] ABSTRACT

A hinge assembly for connecting a door with a frame member includes an arm pivotally secured relative to the frame member, and an arm secured to the door. A spring pin is utilized to secure the two arms together so that the door is pivotally connected to the frame member. The arms and connecting means associated therewith are positioned so that they are inward of the door with such door in its closed position.

7 Claims, 4 Drawing Figures

HINGE DISCONNECT MEANS FOR A DOOR

BACKGROUND OF THE INVENTION

This invention relates to hinge means, and more particularly, to hinge means which allow disconnection thereof to allow convenient removal of a door.

In the pivotal connection of a door relative to a frame member, it is in some instances desirable to provide means which allow for relatively simple and convenient disconnection thereof so as to allow removal of the door from the frame member when so desired. It should also be understood, however, that it is desirable to provide some form of security means, wherein such a hinge assembly cannot be reached for disconnection of the door with such door closed, but can only be reached upon selective movement of the door to an open position.

SUMMARY OF THE INVENTION

It is accordingly an object of this invention to provide a hinge assembly for use with a door and a frame member, such hinge assembly being relatively conveniently disconnectable so as to allow removal of the door from the frame member.

It is a further object of this invention to provide a hinge assembly which, while fulfilling the above object, is positioned so as to only be reachable when the door is in an open position, the door in its closed position blocking access to such hinge assembly.

It is a further object of this invention to provide a hinge assembly which, while fulfilling the above objects, is extremely simple in design and efficient in use.

Broadly stated, the hinge assembly is provided for connecting first and second members, such hinge assembly comprising first arm means pivotally connected relative to the first member, and second arm means secured to the second member. Means are included for interconnecting the first and second arm means to selectively secure the first arm means relative to the second arm means, and to selectively allow disconnection of the first arm means from the second arm means, so that the second member, second arm means and first arm means are pivotable generally together relative to the first member with the first arm means so secured relative to the second arm means.

BRIEF DESCRIPTION OF THE DRAWINGS

These and other objects of the invention will become apparent from a study of the following specification and drawings, in which.

DESCRIPTION OF THE PREFERRED EMBODIMENT

Figure 1:
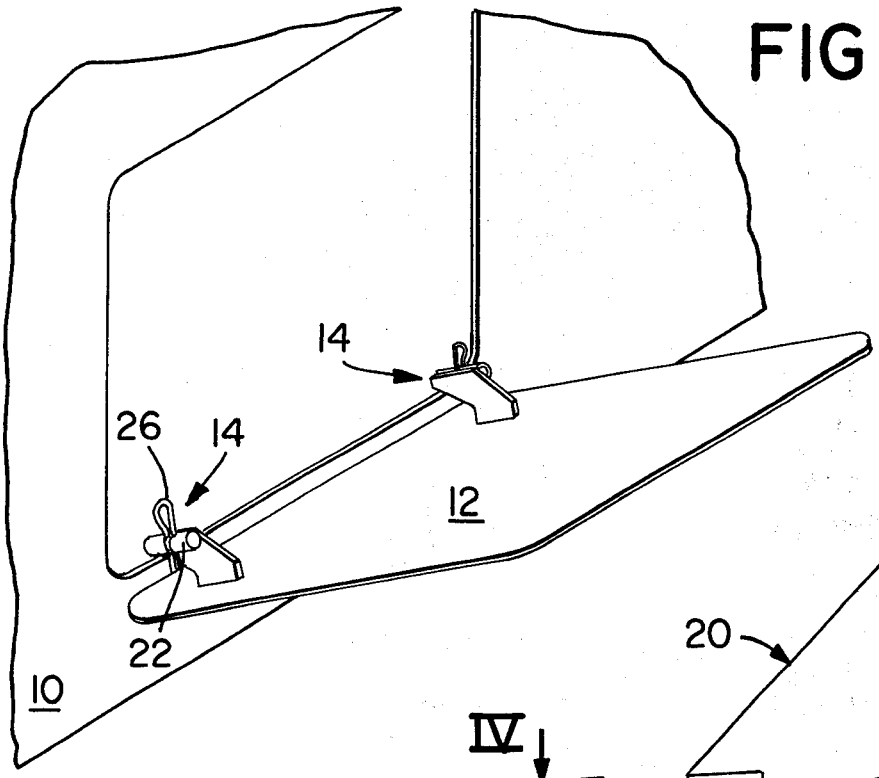
FIG. 1 is a perspective view of apparatus incorporating the inventive hinge assembly.

Shown in FIG. 1 is a main frame 10 which has a member 12 which may take the form of a door pivotally connected thereto, by hinge assemblies 14. As the hinge assemblies 14 are identical in construction, only one such hinge assembly 14 will be described in detail.

Figure 2:
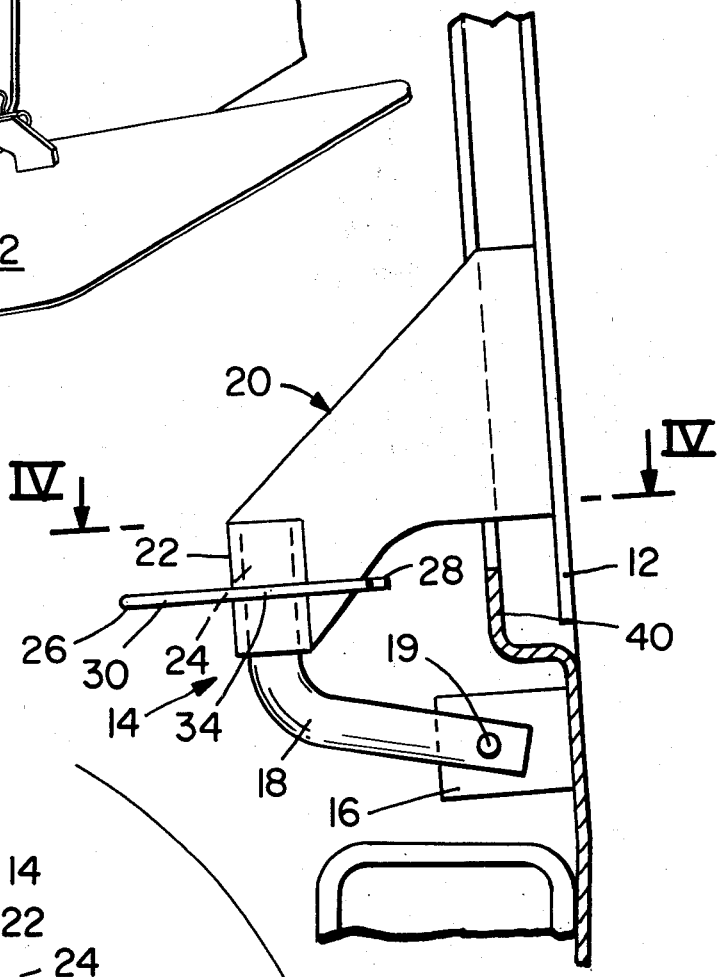
FIG. 2 is a plan view of the hinge assembly and associated structure, with the door thereof in a closed position.
Figure 4:
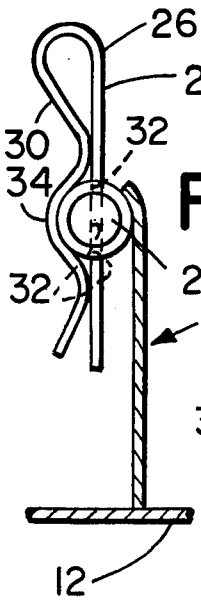
FIG. 4 is a sectional view taken along the line IV—IV of FIG. 2.
Figure 3:
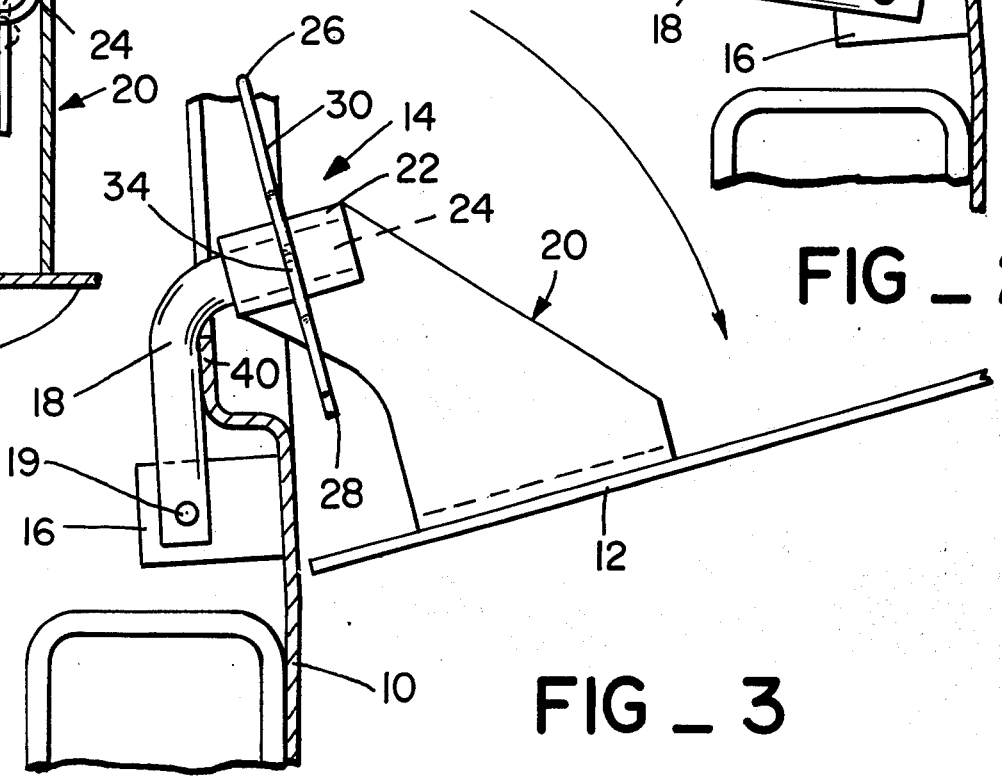
FIG. 3 is a view similar to that shown in FIG. 2, but with the door pivoted to its open position.

Such hinge assembly 14 is shown in detail in FIGS. 2, 3 and 4. In such hinge assembly 14, a block 16 is fixed to the frame 10. An arm 18 is pivotally fixed to the block by a pin 19, so that such arm 18 is pivotally connected relative to the frame 10. An arm 20 is secured to the door 12. The arm 20 defines as a portion thereof a tubular portion 22, and the end portion 24 of the arm 18 is positionable within the bore of the tubular portion 22, as shown in FIGS. 2-4. A spring pin member 26, the configuration of which is best shown in FIG. 4, is included for securing the end portion 24 within the tubular portion 22. The spring pin member 26 is of resilient material, and is made up of a first body portion 28 generally straight in configuration, and a second body portion 30 extending from the first body portion 28 as a continuation thereof, with the body portions 28, 30 lying generally along each other, but with the second body portion 30 curved as shown in such FIG. 4.

The end portion 24 and tubular portion 22 are provided with holes 32 therein as best shown in FIG. 4, which may be brought into registry so that the body portion 28 may be positioned through such registered holes 32. In so inserting such pin member 26, a curved portion 34 of the body portion 30 is brought into position to be disposed around a portion of the tubular portion 22. Additionally, portions of the tubular portion 22 and end portion 24 are disposed between the first and second body portions 28, 30 of the pin member 26, so that the curved portion 34 of the second body portion 30 bears on such outer surface of the tubular portion 22.

Through such means, it will be seen that the arm 18 is secured relative to the arm 20, and the arms 18,20 may be selectively disconnected by removal of the pin member 26. The resiliency of the pin member 26 and the curved portion 34 being in contact with the tubular portion 22 tend to hold the in member 26 in place relative to the tubular portion 22 and end portion 24 with the body portion 28 so disposed in the registered holes 32.

Through such means, it will be seen that with the structure positioned as shown in FIGS. 2–4, the door 12, arm 20, and arm 18 are pivotable generally together relative to the frame 10.

The frame 10 may, for example, be a vertically disposed side portion of a vehicle, with the door 12 in its closed position shown in FIG. 2 disposed also in a generally vertical position. With the door 12 closed as shown in FIG. 2, the entire hinge assembly 14, including block 16, arm 18, arm 20, and pin member 26, is positioned inwardly of the outer surface of the vehicle defined by the frame 10 and door 12, so that the pin member 26 thereof cannot be reached, i.e., access thereto from outside is blocked by such door 12 and frame 10, so that the hinge assembly 14 cannot be disassembled with the door 12 in such position.

Upon pivoting of the door 12 to its open position, as shown in FIG. 3, the arm 18 contacts a portion 40 of the frame 10, so that the opening pivotal movement of the arm 18, arm 20, and door 12 is limited in such opening direction relative to the frame 10. With the door 12 in such open position, and with the arm 18 bearing on the frame portion 20, the door 12 is positioned generally horizontally.

It will be understood that appropriate seal means may be provided between the adjacent surfaces of the frame 10 and door 12 as shown in FIG. 2 with such door 12 in its closed position, to provide proper sealing therebetween. Additionally, resilient pad means, which may be a portion of such seal means, may be included so as to be positioned between the frame portion 40 and arm 18 to act as a pad therebetween when the door 12 is in its lowermost position.

What is claimed is:

1. A hinge assembly for connecting first and second members comprising:

first arm means pivotally connected relative to the first member;

second arm means secured to the second member; and means interconnecting the first and second arm means for detachably securing the first arm means relative to the second arm means, so that the second member, second arm means and first arm means are pivotable generally together relative to the first member with the first arm means so secured relative to the second arm means;

wherein the means interconnecting the first and second arm means comprise a tubular portion defined by one of said first and second arm means, the end portion of the other of said first and second arm means being positionable within the bore of the tubular portion, and means for securing the end portion within the tubular portion.

2. The assembly of claim 1 wherein the means for securing the end portion within the tubular portion comprises a pin member having a body portion positionable through registered holes defined by the tubular portion and the end portion.

3. The assembly of claim 2 wherein the pin member further comprises a second body portion extending from the first-mentioned body portion as a continuation thereof, the second body portion lying generally along the first body portion, the pin member being of resilient material, a portion of the tubular portion and end portion being disposed between the first and second body portions of the pin member with the first body portion thereof disposed through said registered holes, so that the second body portion of the pin member bears on the outer surface of the tubular portion, tending to hold said pin member in place relative to the tubular portion and end portion.

4. The assembly of claim 3 wherein the second body portion of the pin member defines a curved portion which may be positioned to be disposed around a portion of the tubular portion with the first body portion thereof disposed in said registered holes, to so secure said pin in place with the first body portion thereof disposed in said registered holes.

5. A hinge assembly for connecting first and second members comprising:

first arm means pivotally connected relative to the first member;

second arm means secured to the second member; and means interconnecting the first and second arm means for detachably securing the first arm means relative to the second arm means, so that the second member, second arm means and first arm means are pivotable generally together relative to the first member with the first arm means so secured relative to the second arm means;

wherein one of the first and second arm means is positioned to contact the first member to limit pivotal movement of the second member and first and second arm means generally together in one direction relative to the first member.

6. The assembly of claim 5 wherein the first arm means is pivotable to contact the first member to limit pivotal movement of the second member and first and second arm means generally together in one direction relative to the first member.

7. The assembly of claim 6 wherein the second member is positioned generally horizontally with the pivoting thereof in said one direction limited by said contacting of the first arm means and first member.

* * * * *